United States Patent [19]

Singleton

[11] 4,036,475

[45] July 19, 1977

[54] DEVICE FOR INSTALLING CEILING INSULATION

[76] Inventor: O'Neal Singleton, 412 W. 7th St., Donaldsonville, La. 70346

[21] Appl. No.: 728,468

[22] Filed: Sept. 30, 1976

[51] Int. Cl.[2] ..... B66F 3/00

[52] U.S. Cl. ..... 254/133 R; 214/1 SW; 254/95

[58] Field of Search ..... 214/1 S, 1 SW; 254/2 R, 254/133, 134, 6, 95

[56] References Cited

U.S. PATENT DOCUMENTS

| | | | |
|---|---|---|---|
| 1,804,299 | 5/1931 | Yentsch | 254/2 R |
| 2,969,220 | 1/1961 | Spencer | 214/1 SW |

*Primary Examiner*—Al Lawrence Smith
*Assistant Examiner*—Robert C. Watson
*Attorney, Agent, or Firm*—Roy, Kiesel, Patterson, Hudson and Abadie

[57] ABSTRACT

A device for positioning insulation for attachment to roof structures having a lifting assembly for lifting an insulation support rack with an insulation bundle release mechanism.

1 Claim, 22 Drawing Figures

DEVICE FOR INSTALLING CEILING INSULATION

BACKGROUND OF THE INVENTION

1. Field of the Invention

This invention relates to devices for positioning of insulation for attachment to roof structures.

2. Prior Art

The present technique for attaching layers of fiberglass insulation to ceilings, particularly in commercial buildings, includes the steps of welding or otherwise attaching metal spikes to the ceiling and then hand lifting the insulation material in position for securing to the spikes.

These prior art techniques are not only slow, but physically very hard on the persons who must lift up to six layers of insulation material at one time constantly during the full working day.

SUMMARY OF THE INVENTION

Therefore, one object of this invention is to provide a device which can lift multiple layers of insulation material.

Another object of this invention is to provide a device that relieves most of the physical requirements of a person during the installation of insulation material in ceilings.

A still further object is to provide a device which can position insulation material for securing to ceiling much faster than conventional methods.

These and other objects and advantages of this invention will become apparent from the ensuing descriptions of the invention.

Accordingly, a device for lifting layers of insulation material in a position for attaching to a ceiling is provided having a support platform on which the layers of insulation material can be laid and a lifting assembly attached to the support platform which lifts the support platform.

PREFERRED EMBODIMENT OF THE INVENTION

Referring to FIGS. 1 - 4 the insulation lifting device, denoted generally by the numeral 1, comprises basically a support platform 2, a lifting assembly 3 and securing means 4.

Figure 1:
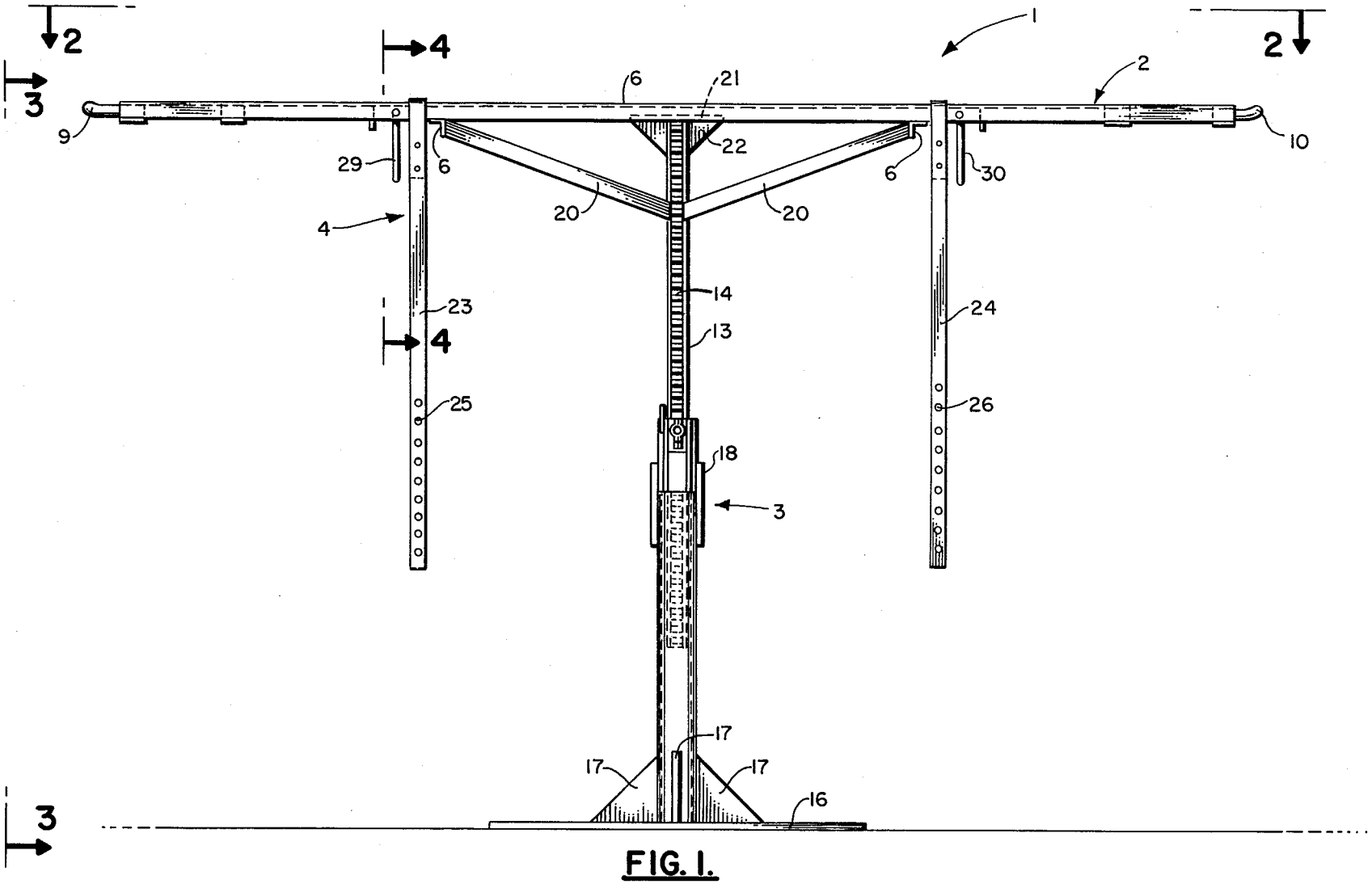
FIG. 1 is a side perspective view of one embodiment of this invention utilizes a manual jacking mechanism.
Figure 2:
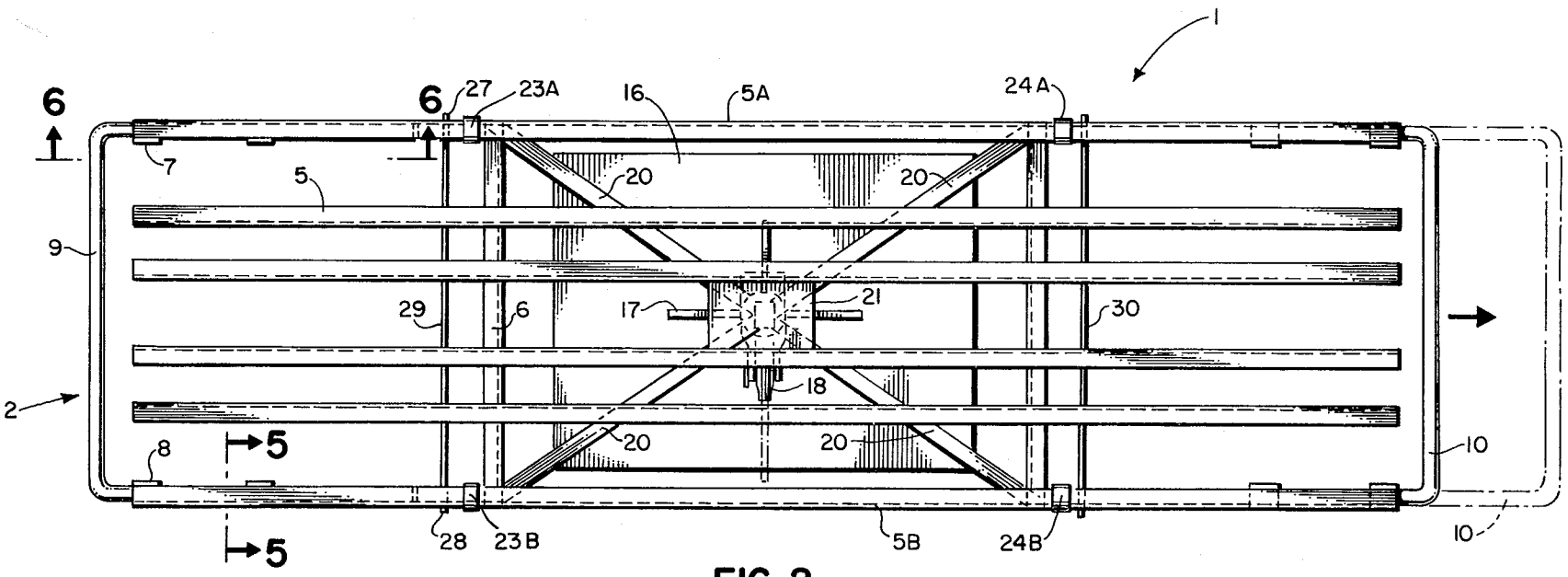
FIG. 2 is a top perspective view taken along lines 2 — 2 of FIG. 1 illustrating the support rack.
Figure 3:
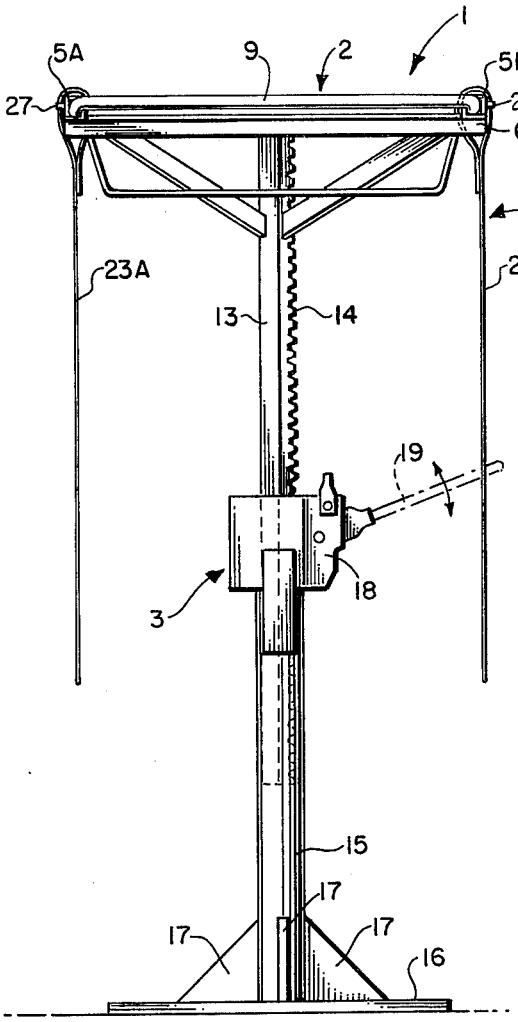
FIG. 3 is an end perspective view taken along lines 3 — 3 of FIG. 1.
Figure 5:
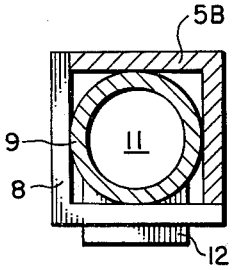
FIG. 5 is a cross-sectional view taken along lines 5 — 5 of FIGS. 2 illustrating sliding connection of end extension member of the top rack.

Support platform 2 comprises a series of parallel L-shaped metal bars 5 attached to and secured in position by perpendicularly positioned L-shaped metal bars 6. Outside metal bars 5A and 5B are provided with L-shaped members 7 and 8 respectively, located at each end of bars 5A and 5B which form a channel 11 through which extension rod members 9 and 10 slide, as best seen in FIGS. 2 and 5. Each rod member 9 and 10 is provided with a stopping plate 12 which extends below L-shaped members 7 and 8, preventing the passage of rod members 9 and 10 completely through channel 11.

Lifting assembly 3 comprises a metal rod 13 having racheting notches 14 cut into one of its edges, a tubular member 15 into which rod 13 can extend inward, a support base 16 to which tubular member 15 is attached and supported by metal plates 17. Also attached to rod member 15 is a conventional racheting mechanism assembly 18 with lever 19 which when jacked up and down can lift or lower racheting rod 13 within tubular member 15 in a conventional manner. Racheting rod 13 is attached to support platform 2 by extension rods 20 that are connected to L-shaped metal bars 6, as well as being attached by plate 21 connected to L-shaped metal bars 5 and supported in position by plate members 22.

Securing means 4 comprises strap members 23 and 24 which are attached to outside L-shaped members 5A and 5B as shown. Each strap 23 and 24 is provided with adjustment openings 25 and 26 respectively, which can be secured to rod ends 27 and 28, respectively, or release assembly 29 and 30, respectively. In a preferred feature, there will be four straps 23A, 23B, 24A and 24B positioned on the outside L-shaped rods 5A and 5B as illustrated more clearly in FIG. 2. The positioning of the insulation material on support platform 2 is illustrated in FIGS. 11 through 14. Two bottom layers 31 and 32 are overlapped on top of L-shaped channel bars 5 so that their ends 33 and 34, respectively, overhand L-shaped rod members 5A and 5B as shown. The additional insulation layers 35 are then placed on top of the overlapped layers 31 and 32 in a centered position. The overlapping ends 33 and 34 are then folded up and over the top of insulation layers 35 and held in this position by securing strap members 23 and 24 over the top of ends 27 and 28 through openings 25 and 26, respectively, as is more clearly illustrated in 13A and FIG. 14. After all four straps 23 and 24 are similarly secured, the insulation material is in positioning for being lifted to the building's ceiling for placement.

Figure 15:
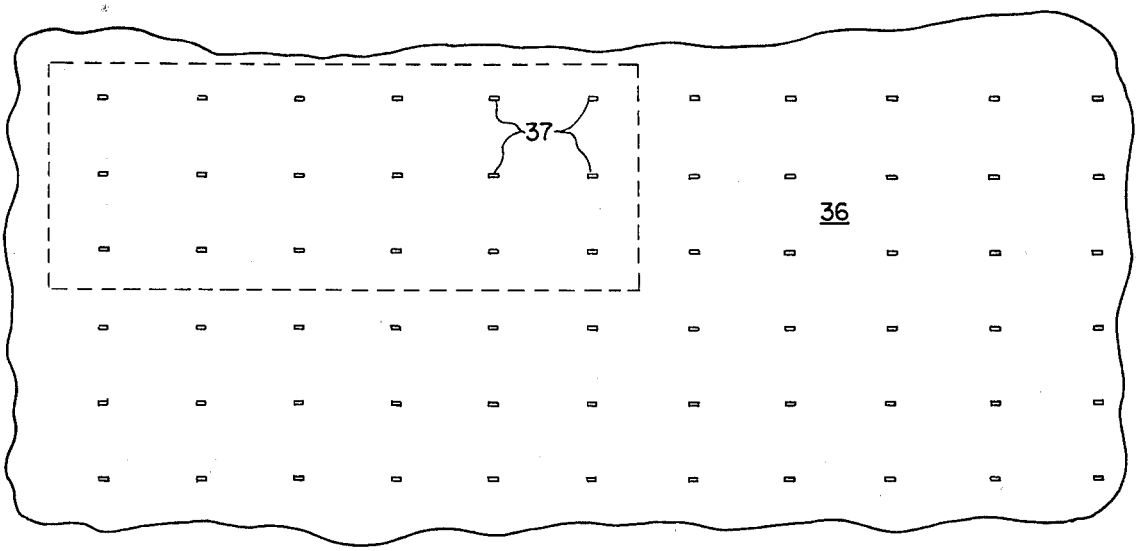
FIG. 15 is a top view of the ceiling showing placement of the pins in association with the position of support rack.
Figure 16:
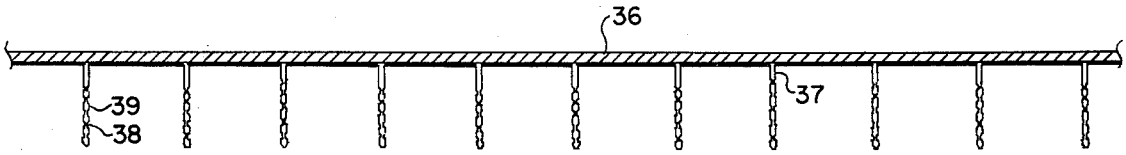
FIG. 16 is a side view of the pins welded to the ceiling.
Figure 17:
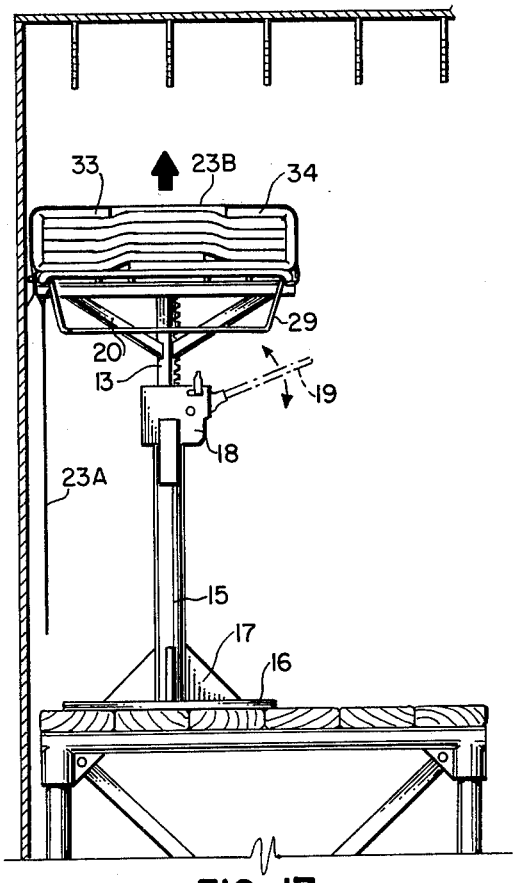
Figure 21:
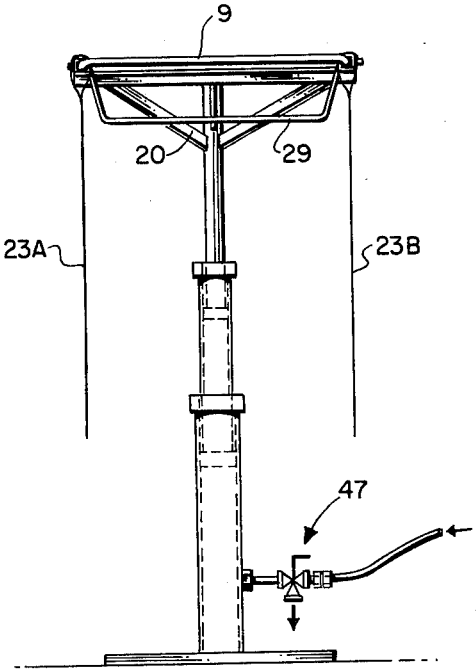
FIG. 21 illustrates an alternate embodiment of using hydraulic means to lift the support rack.

The ceiling 36 is prepared by welding metal spikes 37 (See FIGS. 9, 10, 15 and 16) in a patterned arrangement similar to that shown in FIG. 15. Each spike comprises a flat metal bar having notches 38 cut into its edges 39 which will be used to secure an insulation holding face 40 in a manner to be explained hereinafter.

Figure 7:
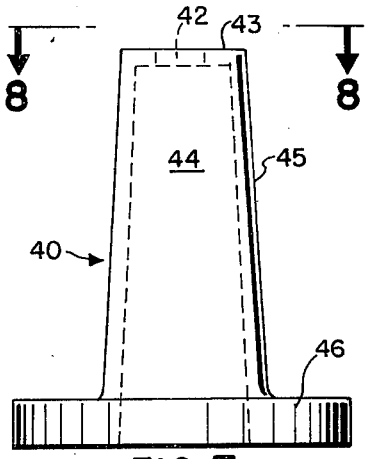
FIGS. 7 and 8 are side and top views, respectively, of retaining laps used to secure the insulation material to pins welded in the building's ceiling.
Figure 8:
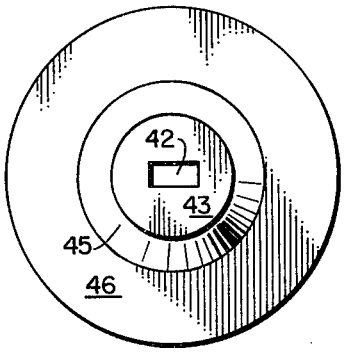
Figures 9, 10:
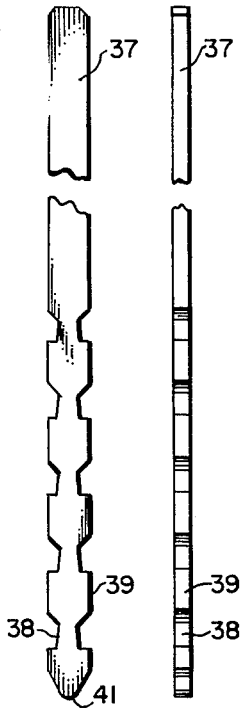
FIGS. 9 and 10 are front and side views, respectively, of securing pins welded to the building's ceiling.
Figure 6:
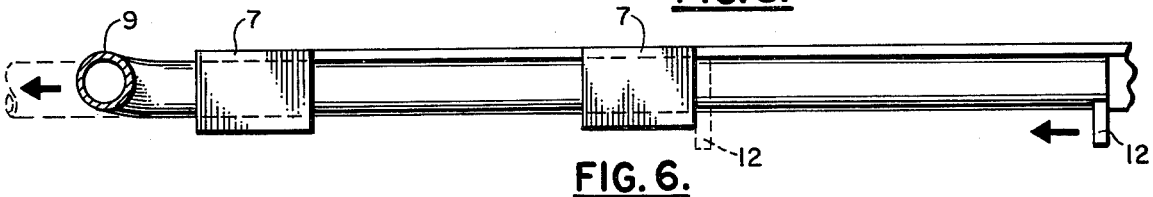
FIG. 6 is a cross-sectional view taken along lines 6 — 6 of FIG. 2 also illustrating the sliding connection of end extension member of the top rack.
Figure 20:
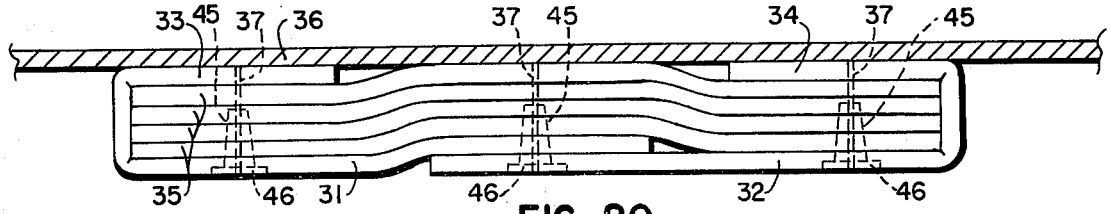
FIGS. 17 - 20 illustrate the steps in lifting and securing the insulation to the ceiling.
Figure 4:
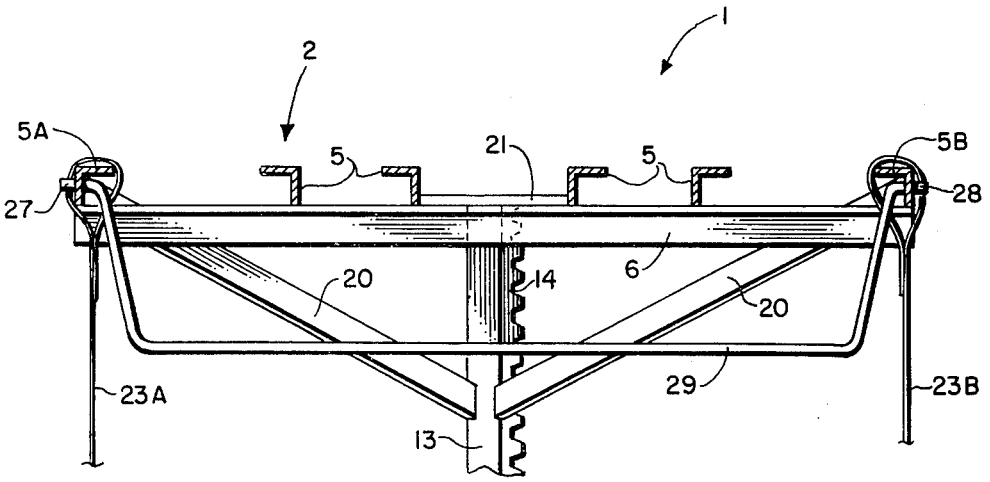
FIG. 4 is a detail end view taken along lines 4 — 4 illustrating the connection of restraining straps to the support rack.
Figure 11:
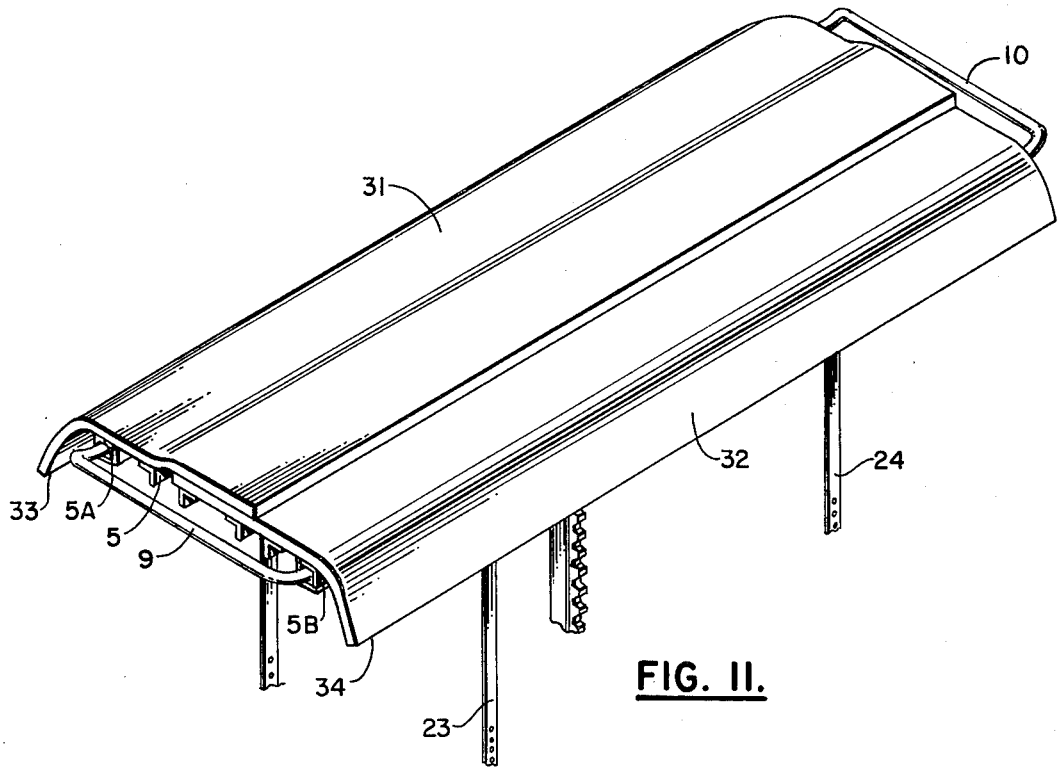
FIGS. 11 - 14 are perspective views illustrating the steps used in placing the insulation material on the support rack.
Figure 12:
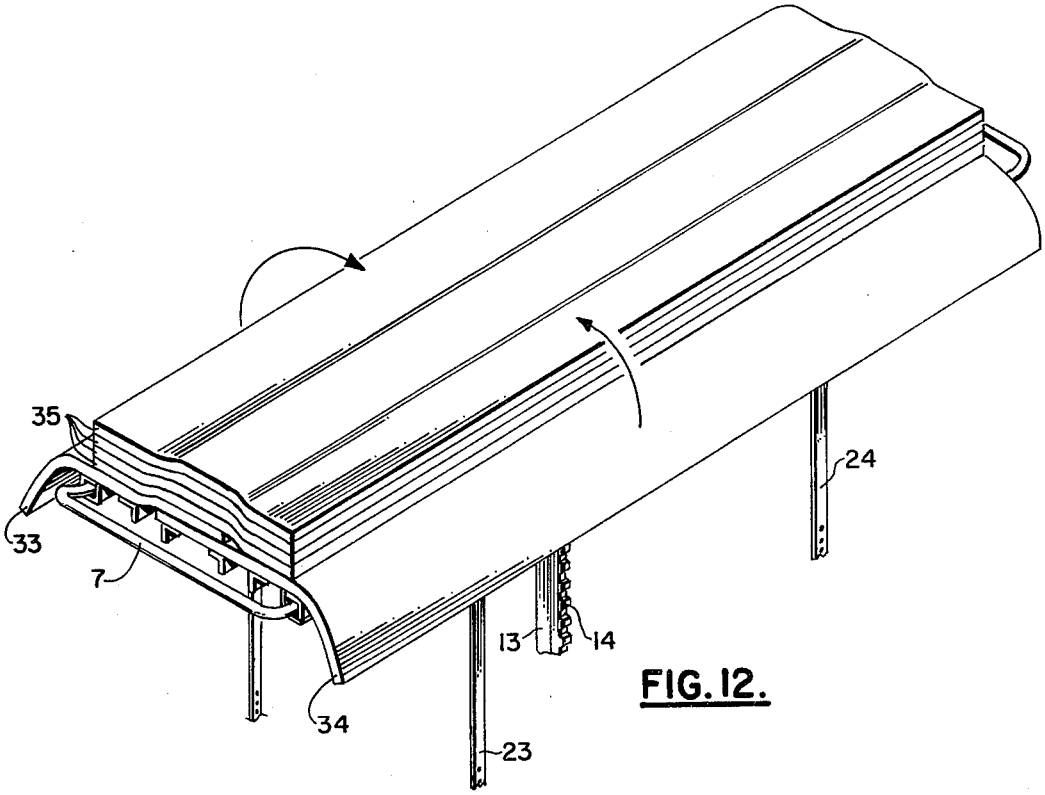
Figure 13:
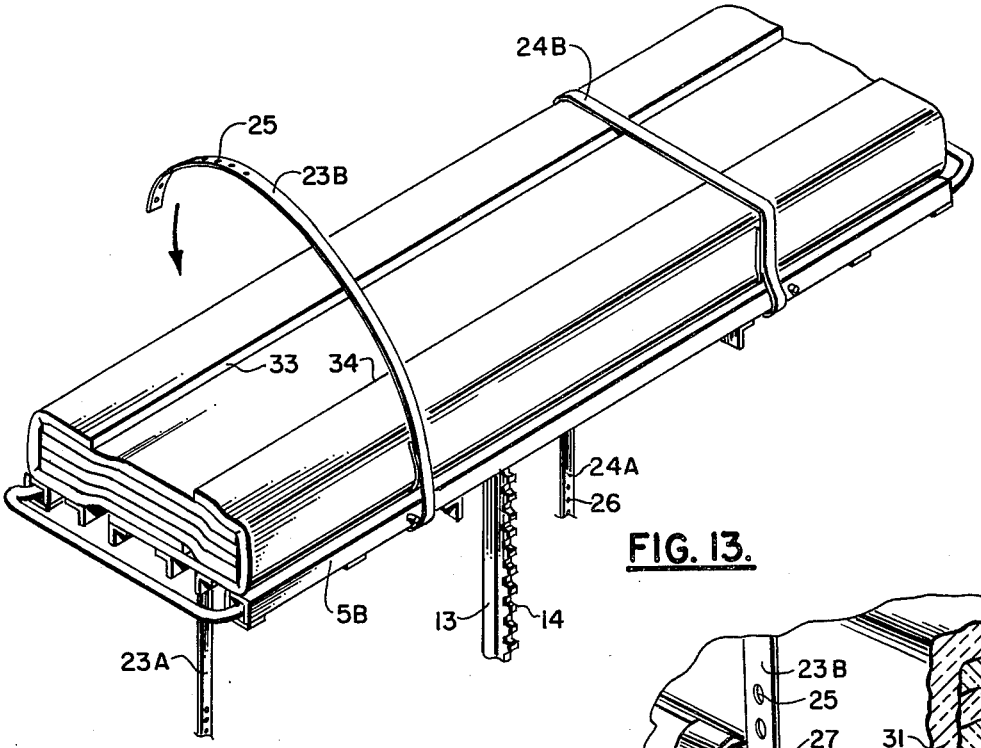
Figure 13A:
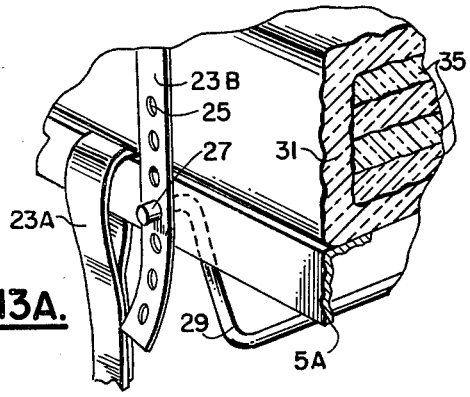
FIG. 13A is a detail perspective illustrating how the securing strap is attached in securing position.
Figure 14:
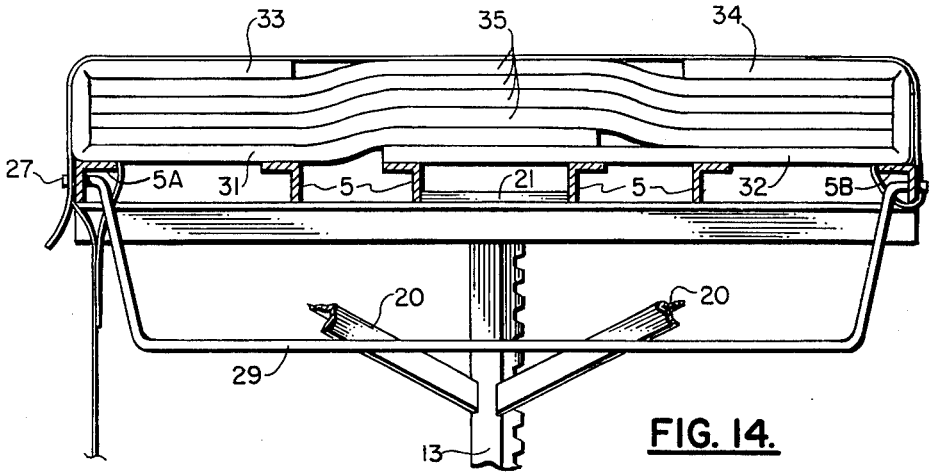
Figure 18:
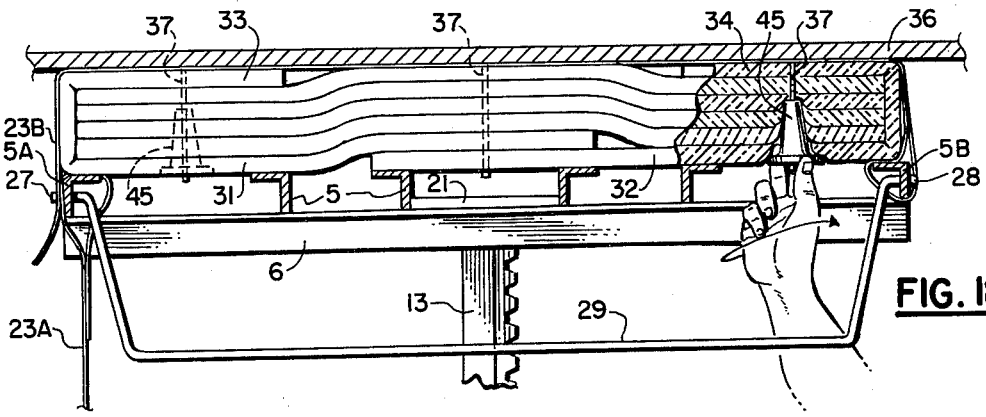
Figure 19:
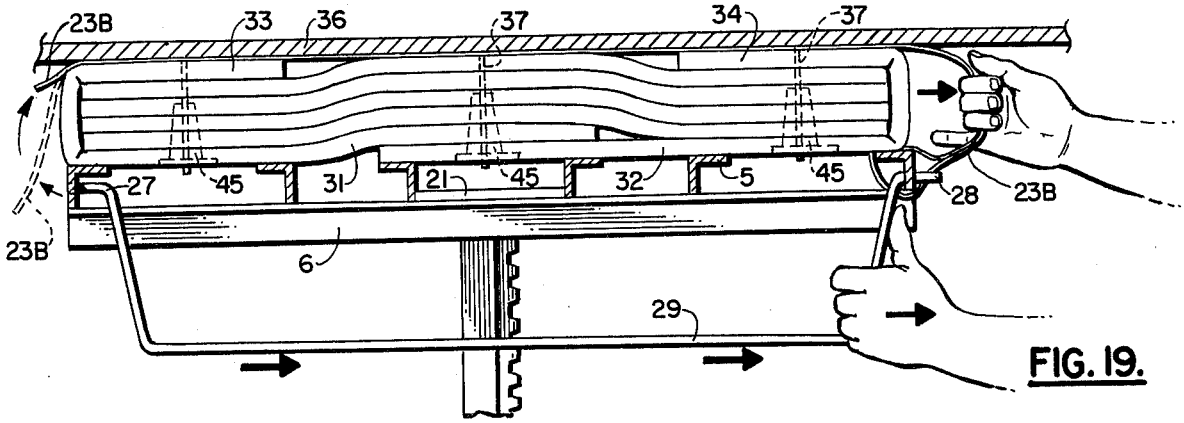

Referring now to FIGS. 17 through 20, the steps of securing the insulation material to the ceiling is seen. Lever 19 of conventional racheting mechanism 18 is moved up and down forcing rachet rod 13 upward. This upward movement is continued until ceiling spikes 37 are forced through each layer of insulation material as shown in FIG. 18. Securing plates 40 (See FIGS. 7, 8 and 18) are then secured onto spikes 37 by passing spike end 41 through the rectangular slot 42 located in end 43 of plate 40 having channel 44 running down side walls 45 and through gripping plate 46 as shown. Once securing plate 40 is pushed sufficiently up into insulation layers 31, 32 and 35, it is twisted so that spike sides 39 are perpendicular to the narrow portion of the rectangular opening 42, and thus are secured in position. After all securing plates have been engaged with spike members 37, straps 23 are released from end members 27 and 28 by gripping the curved portion of release assembly 29 and pulling release assembly 29 in the direction indicated in FIG. 19. Straps 24 are then likewise pulled loose by pulling release assembly 30, and the lifting device 1 is lowered leaving the insulation material secured in position as shown in FIG. 20.

In an alternate embodiment, conventional hydraulic means 47 could be used instead of racheting mechanisms 80 for the purposes of raising and lowering lifting device 1. There are, of course, many alternate embodiments that fall within the scope of this invention, and no limitations are intended to be placed on this invention except as found in the following claims.

I claim:

1. A device for lifting layers of insulation material in a position for attaching to a ceiling which comprises:

a. a support platform on which said layers rest, said platform having openings through which spikes fixedly attached to said ceiling can pass, said platform comprising parallel primary bars attached to and secured relative to one another by secondary bars perpendicular to said primary bars;

b. a lifting assembly attached to said platform having means for raising said platform in position for attaching said layers on said platform; and c. a securing means comprising at least two straps attached at one end to one of said primary bars; each strap having multiple openings at its other ends through which one end member of a releasing assembly can pass, said releasing assembly comprising a curved rod having one end member movably attachable to one of said primary bars and said other end member movably attachable and extending beyond another outside primary bar and through one of said multiple openings.

* * * * *